US005139263A

United States Patent [19]

Feo

[11] Patent Number: 5,139,263

[45] Date of Patent: Aug. 18, 1992

[54] GOLF SWING ALIGNMENT DEVICE

[75] Inventor: Anthony F. Feo, Youngstown, Ohio

[73] Assignee: Mary Lee Feo, Youngstown, Ohio

[21] Appl. No.: 785,017

[22] Filed: Oct. 30, 1991

[51] Int. Cl.[5] ..... A63B 69/36

[52] U.S. Cl. ..... 273/186.1; 273/187 R

[58] Field of Search ..... 273/187 R, 186 C, 186 R, 273/186 B, 183 A, 183 E

[56] References Cited

U.S. PATENT DOCUMENTS 2,150,580 3/1939 Crowley ..... 273/187 R
3,166,327 1/1965 Champion ..... 273/187 R
3,429,577 2/1969 Godden ..... 273/187 R X
3,542,369 11/1970 Anderson ..... 273/186 C
5,042,815 8/1991 Sutton ..... 273/187 R

*Primary Examiner*—George J. Marlo
*Attorney, Agent, or Firm*—John F. McDevitt

[57] ABSTRACT

A golf practice device in the form of a closed frame encircling an open area within which a golf ball may be positioned and including alignment elements which enable the golfer to modify the flight path of a golf ball. The alignment elements are provided in the practice device to serve as guidelines for executing straight, fade, slice, draw and hook shots. The alignment elements are a plurality of visible indicia lines on the frame requiring the golfer to maintain the golf clubface square to the intended target while adopting a swing plane along other visible indicia lines on the frame.

4 Claims, 1 Drawing Sheet

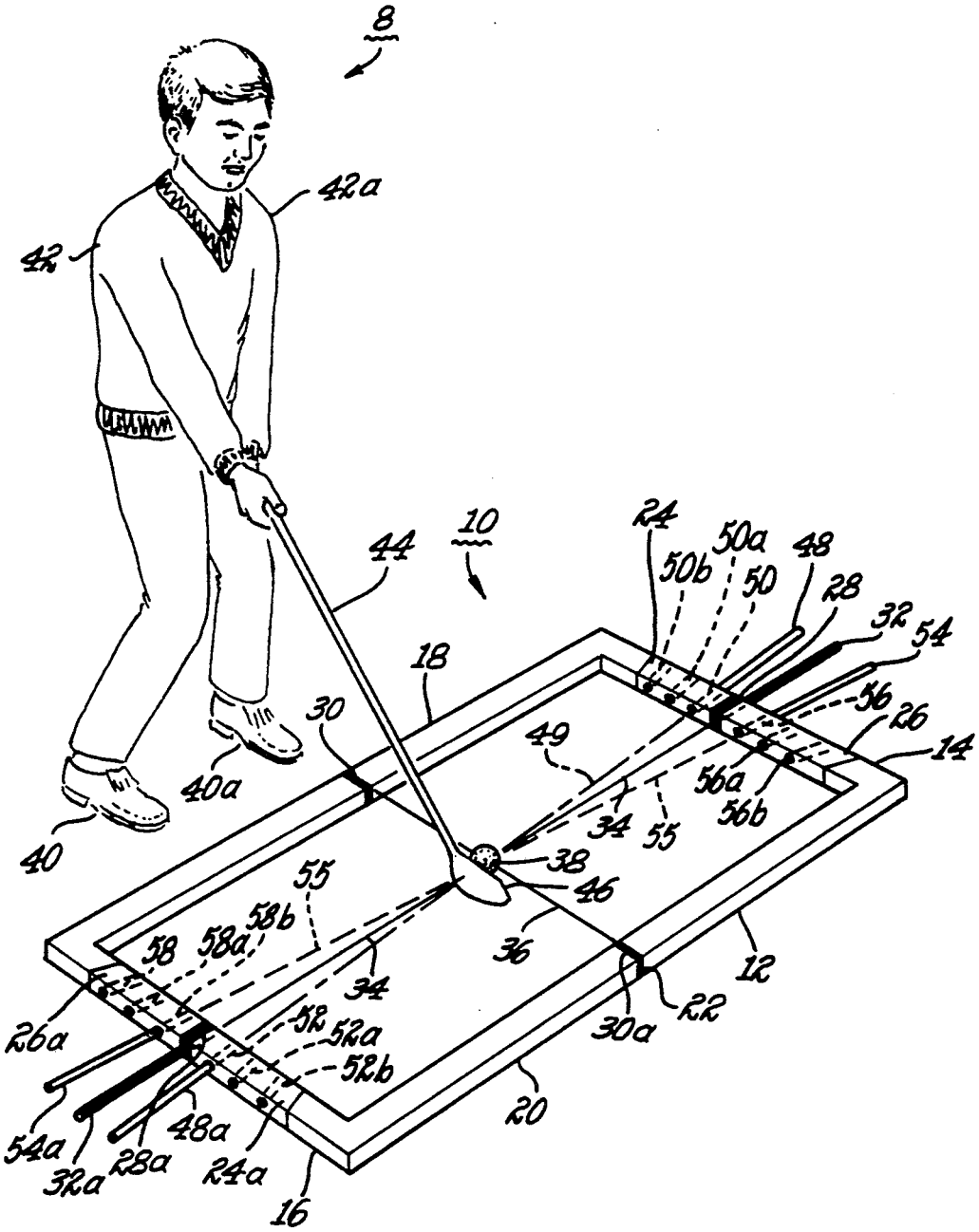
8
42a
42
10
44
24
50a
50b
50
48
28
32
54
18
56
26
14
30
49
56a
56b
34
55
40a
40
38
46
55
58b
58
58a
36
12
34
22
30a
26a
58
52a
52b
20
54a
48a
32a
28a
24a
16

GOLF SWING ALIGNMENT DEVICE

BACKGROUND OF THE INVENTION

This invention relates generally to a practice device for golfers, and more specifically, to a practice training device enabling the golfer to modify the flight of a golf ball.

Improper alignment to an intended target such as the golf green or golf flag is common among inexperienced golfers and occasionally extends to the professional golfer. Another common problem to many golfers is an inability to align the clubface square or perpendicular to the intended target line. Still another problem experienced by many golfers is an inability to take the golf club back and then through in the direction of the target on a correct swing path or swing plane.

Teaching professionals usually employ one or more methods to help golf students achieve proper alignment to an intended target. One method employed with right-handed golfers is to physically align the student's body (feet, knees, hips and shoulders) until it is aligned left of and parallel to the intended target. Another method employed with such students involves laying a golf club on the ground in such a manner that the shaft of the golf club is left and parallel to the intended target. The student is then instructed to use this golf club as a visual aid to help him properly align his body (feet, knees, hips and shoulders) to the intended target. When employing either of these methods, the teaching professional must make a visual check to insure that the student has his clubface properly squared to the target. Many teaching professionals further demonstrate the proper swing path or swing plane to their students; however, this concept is one of the most difficult to teach.

All existing teaching methods or practice devices focus on teaching the golfer one basic golf shot, the straight shot. On the other hand, golf courses are designed in such a manner that a golfer should further have the ability to execute more than such basic golf shot. The golfer should thereby be able to control the flight of his golf ball by developing the ability to execute many different types of golf shots. The types of golf shots include the straight shot, fade, slice, draw and hook. A more versatile teaching aid is thereby needed enabling the golfer to practice all these different types of golf shots.

Accordingly, it is one object of the present invention to provide a novel and improved teaching aid enabling a golfer to practice a variety of golf shots.

It is another object of the present invention to combine the maximum instructional guidance for difficult golf shots into a single teaching device which is both portable and compact as well as easily comprehensible.

It is a further object of the present invention to incorporate the most essential factors enabling different golf shots into a single practice aid, including ball position, body and club alignment and swing path or swing plane.

Still a further object of the present invention is to provide a training aid enabling the golfer to modify the flight of a golf ball to the intended target which is in the form of a single frame device permitting indoor/outdoor use.

These and other objects and advantages of the present invention will become more readily apparent from a consideration of the following detailed description upon preferred embodiments.

SUMMARY OF THE INVENTION

A novel teaching aid has now been discovered enabling the golfer to modify the flight of a golf ball to the intended target. Generally, said teaching aid comprises a frame device having alignment means to establish ball position, golfer's stance and club position relative thereto, in combination with primary guideline means establishing a straight line path to the intended target, and secondary guideline means providing a non-linear or curved trajectory path for the ball in flight. In a preferred embodiment, said frame device is constructed as a picture-frame of generally rectangular configuration having front and rear edges along with longer side edges. Such open type construction enables the frame to be easily folded for transportation to a practice site as well as enabling ball placement in the central free space. Both guideline means in the preferred embodiment can be provided with dowel or rod-like elements extending outwardly from said frame in the selected trajectory path. Such primary guideline means extend from both front and rear edges of the frame to provide a straight line visual path to the intended target whereas such secondary guideline means extend similarly from the frame at an angle relative to the primary guideline path selected for the non-linear trajectory golf shots. For fade and slice shots the secondary guideline means form various acute angles passing through the ball position on the left side of the primary guideline path in a forward-looking direction. The golfer can thereby establish a swing plane along the selected secondary guideline employing a procedure still further dictated in accordance with the present practice device. For hook and draw shots the secondary guideline lines again form various acute angles passing through the ball position but are all disposed on the right side of the primary guideline path in a forward-looking direction to establish the appropriate swing plane for a golfer. Additional alignment means are provided in the present training device to establish a correct set-up for the selected golf shot and which can include color-coding or other type coding of all alignment means to visually aid the golfer.

BRIEF DESCRIPTION OF THE DRAWING

The accompanying drawing provides a perspective view illustrating a golfer aligned in a proper set-up to make a golf shot employing a representative practice device according to the present invention.

DETAILED DESCRIPTION OF THE PREFERRED EMBODIMENTS

Referring to the accompanying drawing, there is depicted a right-handed golfer 8 in the proper set-up stance to employ a typical training device 10 according to the present invention. Said training device 10 comprises a rectangular frame member 12 with front edge 14, rear edge 16, and longer side edges 18 and 20. As can be further seen, frame member 12 employs a hinge construction 22 enabling it to be folded for easier storage and handling. Color coding of said frame member can also be seen with both front and rear edges having respective yellow alignment regions 24 and **24*a*, respective blue alignment regions 26 and 26*a* and respective black alignment regions 28 and 28*a*. Likewise, both side edges include central black alignment regions 30 and 30*a*. The black alignment regions 28 and 28*a* enable insertion thereat of correspondingly color-coded dowel rods 32 and 32a, respectively, to establish a visual primary guideline path to the intended target (not shown) along a longitudinally extending center line 34 of the frame member. Side black alignment regions 30 and 30a locate a stance position 36 for the golfer as well as establishing placement of the golf ball 38 at its intersection with center line 34. As can further be seen in the present drawing, left side edge 18 of the frame member 12 enables alignment of the golfer's feet 40 and 40a as well as both shoulders 42 and 42a to be positioned parallel thereto while holding the golf club 44 in a preparatory swing stance. Such preparatory stance further requires the clubface 46 to be aligned square or perpendicular to center line 34 while addressing the ball. Yellow alignment regions 24 and 24a enable insertion thereat of correspondingly color-coded dowel rods 48 and 48a to establish a selected secondary guideline path 49 enabling the golfer to hit a fade shot from the described stance position. The swing path established along said longitudinally extending dowel rods can be seen to form an acute angle at the ball placement location (38) with center line 34 of the frame member. A plurality of holes 50, 50a, and 50b drilled into yellow region 24 of the frame member together with holes 52, 52a and 52b being drilled into cooperating yellow region 24a enables relocation of said dowel rods for selection by the golfer of varying fade or slice ball flight paths. Blue alignment regions 26 and 26a enable insertion thereat of correspondingly color-coded dowel rods 54 and 54a enabling the golfer to hit a draw shot from the described stance position. The selected secondary guideline path 55 established with said cooperating dowel rods can also be seen to form an acute angle with center line 34 of the frame member at the center ball placement location but does so on the right side with respect to the ball flight path. Again, a plurality of holes 56, 56a, 56b, 58, 58a and 58b** have been drilled to permit golfer selection of varying draw or hook ball flight paths. Acute angles of five (5°), ten (10°) and fifteen (15°) degrees formed in the above described manner have been found to provide a sufficient degree of non-linear ball path employing the illustrated training device. It will also be evident from the above detailed description that the illustrated practice device is intended for use by a right-handed golfer and would be reversed for a left-handed golfer. Moreover, different sizes of said practice device are contemplated for junior, women and men golfers as well as to accommodate different lengths or clubs or personal preference.

PROCEDURE FOR USE OF ILLUSTRATED EMBODIMENT

Step 1: Place the device on the ground or floor having the front edge facing in the direction of an intended target.

Step 2: Insert one of the two black dowels into the hole located at the center point of the front edge in the black region. Insert the remaining black dowel into the hole located at the center point of the black region located in the rear edge of the device.

Step 3: Maneuver the practice device until both the front and rear black dowels are in direct alignment with the intended target. The black dowels have now become a visual target line to the intended target.

Step 4: Using the four black painted areas centrally located on the front, rear, left and right edges of the practice device as a visual aid, place the golf ball on the ground or floor in the approximate center of the training device for direct alignment with the visual target line (black dowels).

Step 5: The golfer practicing straight shots first places his clubface square or perpendicular to the visual target line (black dowels). The side black areas provide a visual aid to assist the golfer in aligning his clubface square to the visual target line (black dowels). Next the golfer uses the left edge of the practice device as a visual aid to help him align his feet, knees, hips and shoulders parallel to the intended target line (black dowels). When the golfer is ready to swing the golf club he can use the visual target line (black dowels) as a guide for his swing path or swing plane.

Step 6: The golfer now utilizes the two Yellow dowels to practice fade and slice shots. The yellow front region of the practice device can further include the words "fade-slice" along with degree indications at the hole sites (5, 10, 15). The rear yellow region can also contain similar indications. To practice a slight fade the golfer inserts the yellow dowels into the five degree holes located in the front and rear yellow regions. The two yellow dowels now provide the golfer with a visual guideline that is pointing slightly to the left of the actual target line (black dowels). The golfer next aligns his feet, knees, hips and shoulders parallel to this secondary guideline (yellow dowels) which now provides the swing path or swing plane to be followed. The golfer swings along such secondary target line with the clubface square to the target line (black dowels). The ball starts slightly left of the intended target but because of the square clubface the ball curves back to the right toward the target. If the golfer wants to put a moderate fade on the ball he inserts the yellow dowels at a ten degree diagonal both front and rear. If the golfer wants to practice a slice he inserts the yellow dowels at the fifteen degree diagonal locations. Regardless of the degree such secondary target line is set at (5, 10, 15), the golfer must always put his club square to the actual target line (black dowels) and maintain his feet, knees, hips and shoulders parallel to such secondary target line (yellow dowels). The higher the degree angle the more the ball will curve from left to right.

Step 7: The golfer now utilizes the two blue dowels to practice draw and hook shots. The blue front region of the practice device can include the words "draw-hook" along with degree indications at the hole sites. The rear blue region can also contain similar indications. To practice a slight draw the golfer inserts the blue dowels into the five degree holes located in the front and rear blue regions. The two blue dowels again provide the golfer with a visual secondary guideline that is pointing slightly to the right of the intended target (black dowels). The golfer again puts his clubface square to the target line (black dowels) but aligns his feet, knees, hips and shoulders parallel to such secondary target line (blue dowels) as the path to be followed in striking the ball. The golfer swings his golf club along such swing path or swing plane with the clubface square to the target line (black dowels). The ball starts its flight slightly right of the intended target but because the clubface is square to the target and slightly closed to the secondary target line the ball will curve right to left toward the target. If the golfer wants to play a moderate draw he inserts the blue dowels at a ten degree diagonal both front and rear. To practice a hook the golfer inserts the blue dowels at the fifteen degree holes to provide the secondary guideline means to be followed.

What I claim as new and desired to secure by Letters Patent of the United States is:

1. A golf practice device to control the flight of a golf ball which comprises a continuous, closed frame defining an open area and including means for establishing a ball position centrally of said frame, a golfer stance position and a square golf club position in combination with primary guideline means employing a plurality of fixed visible indicia lines on said frame to establish a visible straight line path to an intended target and which cooperate with secondary guideline means also employing a plurality of fixed visible indicia lines, the extensions of which intersect at said ball position centrally of said frame to provide a preferred trajectory path for the ball in flight, said cooperation requiring the golfer to align the golf clubface square to the primary visible indicia lines and thereafter adopt a swing plane along the selected secondary visible indicia lines while retaining the golf clubface square to the primary visible indicia lines.

2. The device of claim 1 wherein the frame device is of rectangular straight edge configuration.

3. The device of claim 1 wherein the guideline means are provided with rod-like elements extending outwardly from said frame.

4. The device of claim 3 wherein each pair of rod-like elements are aligned along straight lines passing through the ball position.

* * * * *